US005129212A

United States Patent [19]

Duffey et al.

[11] Patent Number: 5,129,212

[45] Date of Patent: Jul. 14, 1992

[54] METHOD AND APPARATUS FOR AUTOMATICALLY FILLING AND STERILIZING CONTAINERS

[75] Inventors: Craig L. Duffey, Galena; Charles A. Estadt, Groveport; Roger J. Gerdeman, Columbus, all of Ohio

[73] Assignee: Liqui-Box/B-Bar-B Corporation, Worthington, Ohio

[21] Appl. No.: 610,800

[22] Filed: Nov. 8, 1990

[51] Int. Cl.[5] ..... B65B 3/16; B65B 55/06; B65B 55/08; B65B 55/10

[52] U.S. Cl. ..... 53/426; 53/469; 53/473; 53/167; 53/284.7; 141/10; 141/114; 141/313; 422/24; 422/294; 422/304

[58] Field of Search ..... 53/425, 426, 167, 300, 53/381.4, 384.1, 281, 469, 282, 473, 284.7; 141/114, 313, 314, 372, 373, 10; 426/399, 407, 413; 422/304, 23, 24, 294, 31, 32

[56] References Cited

U.S. PATENT DOCUMENTS

| | | | |
|---|---|---|---|
| 3,529,399 | 9/1970 | Schieser et al. . | |
| 3,630,242 | 12/1971 | Schieser et al. . | |
| 4,035,981 | 7/1977 | Braun et al. | 53/167 X |
| 4,056,921 | 11/1977 | Gilliand et al. | 53/167 |
| 4,120,134 | 10/1978 | Scholle | 141/313 X |
| 4,175,140 | 11/1979 | Bachmann et al. | 422/24 X |
| 4,283,901 | 8/1981 | Schieser et al. . | |
| 4,297,929 | 11/1981 | Schieser et al. . | |
| 4,366,125 | 12/1982 | Kodera et al. | 422/24 X |
| 4,386,636 | 7/1983 | Ellert | 141/114 X |
| 4,417,607 | 11/1983 | Scholle et al. | 141/114 X |
| 4,452,030 | 6/1984 | Inada | 53/426 |
| 4,506,489 | 3/1985 | Schieser et al. . | |
| 4,676,285 | 6/1987 | Schieser et al. | 141/114 |
| 4,863,688 | 9/1989 | Schmidt et al. . | |
| 4,877,964 | 10/1989 | Tanaka et al. | 422/24 X |
| 4,962,797 | 10/1990 | Thomsen | 141/314 X |
| 4,981,650 | 1/1991 | Brown et al. | 422/24 |

*Primary Examiner*—Horace M. Culver
*Attorney, Agent, or Firm*—Vorys, Sater, Seymour & Pease

[57] ABSTRACT

A method and apparatus are disclosed for automatically filling and sterilizing capped and spouted flexible fluid containers. Included is a mechanism for advancing at least an individual empty container toward a filling station; a sterilizing device for sterilizing at least a portion of each spout in a sterilizing chamber; and a device for advancing each spouted container through the sterilizing chamber. The sterilizing device includes means for introducing gaseous hydrogen peroxide into the sterilizing chamber and a mechanism for radiating the spouts in the chamber with pre-selected ultraviolet radiation. Also enclosed is a device for filling the empty container with the substance in a sterile environments.

34 Claims, 12 Drawing Sheets

METHOD AND APPARATUS FOR AUTOMATICALLY FILLING AND STERILIZING CONTAINERS

BACKGROUND OF THE INVENTION

The present invention relates generally to a method of and apparatus for automatically filling containers and, in particular, to an improved method and apparatus for aseptically filling and capping, empty, flexible bag-type containers.

This invention relates to filling machines used to automatically uncap, fill with flowable fluids, and recap flexible bag-type containers in a sterilized manner. When filling bags with fluid substances used in the food industry, the maintenance of aseptic conditions is, of course, essential during the filling procedure. Some conventional filling machines generally feed a continuous strip of spouted flexible bags, which bags are joined together along transversely oriented perforations, to a separating station. Each bag has either a capped tube or spout associated therewith and is then separated from the strip by a separating device. Thereafter, successive ones of the capped spouts are advanced to a filling station, whereat an accurate amount of fluid substance is metered into each bag, after the bag has, of course, been uncapped. Both the spout and bag are fully supported during the filling cycle and the bag spout is recapped. As noted, it is important that the filling be done in a sterilized manner. Towards this end, known systems typically utilize a steam sterilization system. The latter has certain drawbacks insofar as steam cleaning tends to lead to condensation during the filling procedure with the consequent shortcomings of the fluid substance being diluted and steam tends to be corrosive. Following filling, the filled bags can be automatically loaded onto a conveyor or into a box. As each filled bag is discharged, another bag is advanced automatically to the filling station for the next filling operation cycle.

With these known systems it is mandatory that the filling head and chamber mechanisms be cleaned. A variety of approaches have been employed. One that is fairly common is to manually remove, scrub and wash the components thereof and then sterilize such components. Of course, manual cleaning is less than entirely satisfactory because it, among reasons, is laborious and time consuming not to mention does always lend itself to sterile conditions during reassembly.

While filling machines of the aforenoted type perform adequately, there is nonetheless a desire to improve upon their performance in terms of a number of factors including enhanced sterility of machine, spout and caps, ease of operation, and improved bag filling rates.

SUMMARY OF THE INVENTION

According to one aspect of the invention, there is included an apparatus for filling empty spouted containers with a substance. The filling apparatus comprises means for advancing at least an individual empty one of the containers toward a filling station. Provision is made for means for sterilizing at least a portion of each spout. Provision is made for means for advancing each spouted container through the sterilizing means. The sterilizing means includes means for introducing gaseous hydrogen peroxide into a sterilizing chamber formed by the sterilizing means and means in the sterilizing chamber for irradiating the spouts with preselected ultraviolet radiation. Provision is made for means for filling the empty containers with a substance in a sterile environment.

Another illustrated embodiment for an apparatus for sterilizing and filling spouted and capped bags is envisioned. Included in the apparatus is means for automatically feeding and separating empty flexible bags from a continuous strip of the same so that the capped spouts are in a desired orientation for subsequent processing steps. Provision is made for advancing and separating means which are selectively operable for engaging the strip and separating individual bags therefrom for subsequent advancement to a sterilizing station. At the sterilizing station, provision is made for means operable for sterilizing at least the container spout and cap in a sterilizing chamber which includes means for introducing at least a gaseous hydrogen peroxide medium to the chamber and for subjecting the spouts and caps to ultraviolet radiation. Following this sterilizing step, the spouted bags are advanced to a filling head and capping means which includes an enclosed and sterile chamber. The filling head and capping means is operable for receiving each spouted bag for filling the bag. The cap is removed and a selected amount of fluid substance fills the bag followed by capping of the spout.

In another illustrated embodiment, there is provided an improved bag advancing device which includes a pair of independently actuated spout pushing assemblies. Each pushing assembly is separately mounted and spaced laterally apart from the other. Each pushing assembly includes an elongated and pivotable spout engaging arm having a spout engaging portion at a distal end of the arm. In one position, the spout engaging portion is engaged with a spout and in a second position it is raised from the spout. Means are provided for pivotally raising and lowering the spout engaging arms. In the spout engaging position the pushing assembly is actuated to advance the spouted bag along a preselected path.

A stopping assembly stops the pushing assembly so that the spouted bag and thereby the perforated seam is at a location, whereby the seam can be separated by a bag separating device. Following release by the stopping assembly, each pushing assembly is further advanced to a sterilization station. In another embodiment, the sterilization station can be replaced by a filling and capping station.

In another illustrated embodiment, there is provided an improved conveying means including a pair of laterally spaced apart and endless type conveying assemblies. Each one of which includes a plurality of horizontally extending slats provided with appropriate arcuate portions so as to cooperate with arcuate portions in adjacent slats for engaging the spout and for moving the same along the preselected path. The conveying assemblies are driven by the spout pushing assembly which forces successive spouts into engagement with the recessed openings formed by the slats so as to provide for a simplified spout and bag advancing mechanism.

In another illustrated embodiment, the sterilization chamber includes a sterilizing assembly which includes a sterilizing tunnel. The sterilizing tunnel encloses the capped spouts as they are advanced along by the conveying slats. The gaseous hydrogen peroxide is introduced through suitable ports along the length of the tunnel. The ultraviolet irradiation is accomplished by ultraviolet lamps being housed within the tunnel.

In another illustrated embodiment, there is provided a transfer station between the sterilizing chamber and the filling head and capper assembly chamber. The transfer station includes means for pushing respective spouts from the conveyor into a housing of the filling head and capper means.

In another illustrated embodiment, there is provided a kettle for placement over an inner housing of the noted filling head and capper means. The kettle allows a cleaning fluid to be introduced into the inner chamber and around the inner chamber of the filler head and capper assembly so that the interior and exterior components thereof may be suitably cleaned without requiring the inner housing and capper mechanism components to be removed for cleaning.

The present invention contemplates methods of operation for achieving the foregoing.

Among the other objects and features of the present invention are the provision of an improved automatic fluid bag filling apparatus; the provision of an improved filling and capping machine of the foregoing type which provides for improved sterilization of the cap and spout; the provision of an improved filling and capping machine of the foregoing type which provides for an improved bag filling production rate; the provision of an improved filling and capping machine of the foregoing type which provides for a simplified and relatively high speed bag filling rate; the provision of an improved filling and capping machine which includes improved clean-in-place operation for the filling head and capper mechanisms; the provision of an improved filling and machine of the foregoing type wherein the degree of sterilization achieved is capable of satisfying government standards for low acid types of liquid materials; the provision of an improved filling and capping machine of the above type which reduces significantly potential contamination of spout and cap; and the provision of an improved filling and capping machine of the foregoing type which is easy and economical to manufacture and use.

Still other objects and further scope of applicability of the present invention will become apparent from the detailed description to follow when taken in conjunction with the accompanying drawings in which like parts are designated by like reference numerals throughout the several views.

DETAILED DESCRIPTION

Reference is made to FIGS. 1-18 for showing one preferred embodiment of the present invention. It is directed to an automatic fluid substance filling machine 20 which fills, to a desired capacity, successive, empty and flexible fluid bag containers 22 in a manner such that the spouts S and caps C of such bags are sterilized prior to filling. The caps C are of the type which are insertable and removable by relative axial movement to the spouts S.

Figure 1:
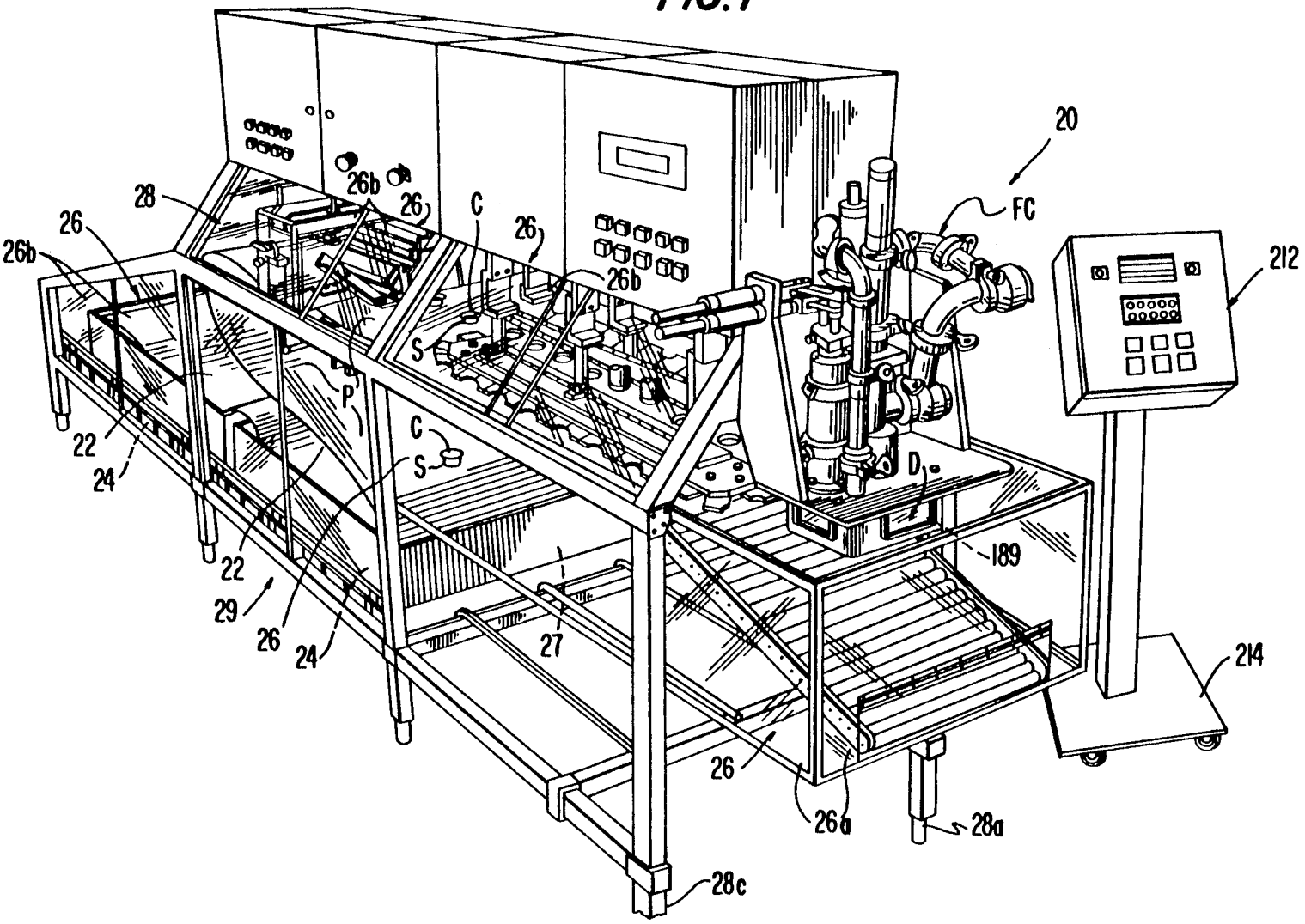
FIG. 1 is a perspective view of an improved filling machine made according to the principles of the present invention.

Initial reference is made to FIG. 1. In this particular embodiment, filling machine 20 is adapted to uncap, fill and recap successive ones of spouts S in a sterile process. The fluid bags 22 can be a well-known type of flexible bag, such as described in U.S. Pat. No. 4,601,410. A variety of liquid substances can be used to fill the flexible bags 22. While the present embodiment discloses a filling machine 20 for filling flexible fluid bags 22, it will be appreciated that the scope of the present invention envisions sterilizing the spout S and cap C of other kinds of containers. Also, this invention contemplates use of various types and sizes of spouts and caps. Each spout S may be provided with a plurality of axially spaced peripheral flanges generally designated by reference character F. The flanges F serve to facilitate holding the spout S during bag travel as well as for cap C removal and replacement. Also, the cap C may be provided with at least one peripheral flange or rib (not shown) to facilitate its application to or removal from the spout S.

Prior to being introduced to the filling machine 20, the bags 22 have been pre-sterilized and are housed an inner liner of a corrugated shipper carton or box 24. The bags 22 are arranged in a continuous strip T so that each bag is connected at transverse perforated seams P. In this manner, the spouts S and caps C are oriented in a predetermined spaced apart relationship to one another to the point of separation in the machine 20. The strips T in successive boxes 24 are conventionally connected at appropriate leading and trailing edges by tape so that the bags strips of both cartons can be fed to a filling head and capping assembly. The bags 22 in the boxes 24 are slid into in a pre-heating enclosure 26 which has a box ingress door (not shown) and a pivotal egress door 27 for exiting boxes. The pre-heating enclosure 26 is formed by transparent panels 26*a* so as to allow an operator to observe the operation. Panels 26*b* are slidable.

The pre-heating enclosure 26 is an integral part of the overall fluid filling machine frame assembly 28. The frame assembly 28 comprises plurality of horizontal and vertically interconnected supporting members including vertically adjustable legs 28*a*. Prior to the sterilizing station, the enclosure 26 is partitioned, by a wall not shown, so it is maintained at less than atmospheric pressure to ventilate any hydrogen peroxide fumes. That part of the enclosure 26, which encompasses the separator, sterilizing and filling and capping stations is above atmospheric pressure for reasons which become apparent. Although not depicted, the filling machine 20 includes suitable monitoring apparatus for monitoring the temperature and ventilation within the heating enclosure 26.

The pre-heating serves several functions. One is to eliminate gross contamination of the bags 22 following the opening of the box liner. Another is to get the caps C and spouts S up to a temperature which minimizes significantly subsequent condensation thereon when later travelling through the sterilization chamber to be described. It will be understood that condensation does not hinder the kind of sterilization which is practiced by this invention but increases residuals of droplets of hydrogen peroxide which is generally undesirable. Towards the end of minimizing such condensation, the pre-heating enclosure 26 can be provided with a heating element (not shown) which heats the enclosure to a temperature of about 140° F. in the lower part and about 120° F. in the upper part. Additionally, heated bags are more pliable and feed better than relatively colder bags. Moreover, uniformly pre-heated bags insures greater uniformity in bag handling characteristics. Other suitable temperatures are contemplated.

The leading edge of the first bag strip T is initially hand fed into the bag feeding and separating mechanism 30. The feeding and separating mechanism 30 basically functions to feed and separate the bags as will be described presently.

Reference is also made to FIGS. 2–6. In essential respects, the feeder and separator apparatus 30 includes a planar and horizontal supporting bed 36 for supporting travel of the strip T thereacross. Connected to and spaced above the supporting bed 36 is a pair of laterally positioned and longitudinally extending parallel tracks 38. The tracks 38 define therebetween a suitable elongated spout channel 40 for guiding the spouts S.

The feeder and separator assembly 30 includes a strip advancing assembly 42. Included in the strip advancing assembly 42 is a pair of laterally spaced apart, longitudinally extending and independently reciprocatable spout pushing means or mechanisms 44. Basically, each pushing mechanism 44 provides reciprocatable movement along the length of the channel 40 to selectively engage and advance alternate spouts S and caps C along the channel. The pushing mechanism 44 includes a well-known reciprocatable pushing device 46 which includes and is mounted for reciprocation upon and by a piston-cylinder 48 and includes an air cylinder 54. The air cylinder 54 is connected to the bottom of the pushing device. Since each pushing device 46, piston-cylinder 48 and air cylinder 54 are commercially available details, of their construction do not, per se, form an aspect of the present invention. Accordingly, only those aspects thereof necessary for understanding the present invention will be set forth.

As best shown, each pushing device 46 is mounted for reciprocating movement on a corresponding piston-cylinder 48 and on a corresponding spaced mounting rod 50. Both the latter of which are connected to and between the depending mounting brackets 52. Reciprocating longitudinal movement of the pushing device 46 is effected by movement of the piston (not shown) of the piston-cylinder device 48 reciprocating in response to suitable fluidic actuation thereof. It will be appreciated that in this commercial device, the piston and the pushing device 46 are magnetically coupled.

Figure 5:
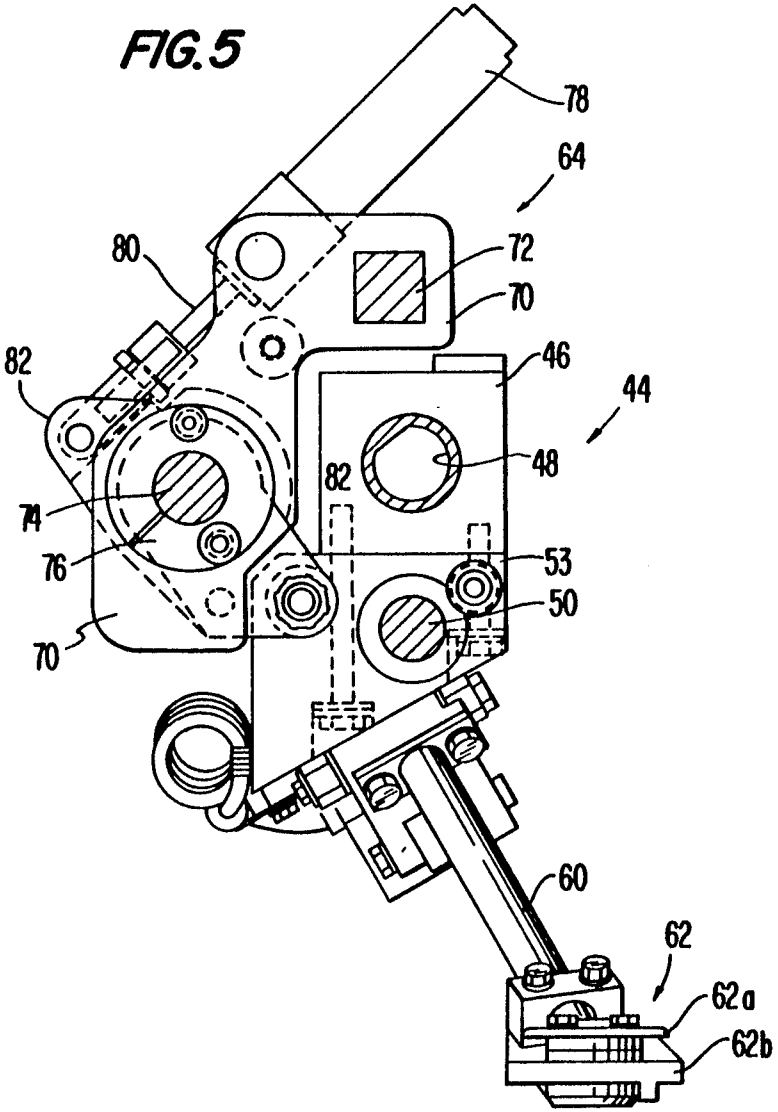
FIG. 5 is a fragmented and enlarged front view of a feeding stop mechanism according to the present invention.

An aspect of this invention is that the air cylinder 54 is mounted to the bottom of the pushing device 46 so as to extend at an angle relative thereto (see FIG. 5). Piston rod 56 of the air cylinder 54 is connected to lift arm 60 which is pivotally mounted to the bottom pushing device 46. An elongated pusher arm 60 extends from the lift arm 58 and has at a distal end thereof a spout engaging assembly 62 comprising spaced apart spout engaging members 62*a*, 62*b*. Then members 62*a*, 62*b* have a space therebetween to cooperate with a flange on the spout. It will be appreciated that operation of the air cylinder 54 is effective to raise the pusher arm 60 from its lower or spout engageable position, as shown, to an elevated non-engaging position, whereby it will not interfere with the other arm 60.

After a spout S of the leading edge of the strip T is advanced between the channels tracks 38, a pusher arm 60 is lifted so that the spout engaging assembly 62 can be positioned to subsequently engage the spout in the channel. This occurs at the starting position, when the pushing device 46 is at its leftmost position, see FIG. 2. For purposes of clarity, several components of the strip advancing assembly 42 have been removed from FIG. 2. Advancement of the pushing device 46, rightwardly toward the filling and capping assembly FC, of course, advances the spout S and thereby the strip T.

Advancement of the strip T and the pushing device 46 will cease upon operation of a stopping assembly 64 which is best seen in FIGS. 3–6. The stopping assembly 64 is adjusted so that the perforated seam between respective bags 22 on the strip T are positioned at a separating station 66 whereat a known bag separating unit is actuated for separating adjacent bags along the perforated seam. The separating unit 68 is of a type commercially available from, for instance, Liqui-Box/B-Bar-B Corporation and does not, per se, form an aspect of the present invention. Only those aspects thereof which have been added for purposes of cooperating with the present invention will be set forth.

By having dual spout pushing devices 46 with the pusher arms 60 oriented at the depicted angle relative to the tracks 38 as shown and described, the rate at which the spouts S are advanced along the channel 40 is improved significantly compared with prior art approaches. The pusher arms 60 can be pivoted so as to not interfere when returning to a start position with a trailing pushing arm 60 moving in the feeding direction (left to right).

As will be pointed out, the dual pushing devices 46 are effective to push the spouts S not only through the separating unit 68, but through the sterilizing assembly as will be described.

Figure 2:
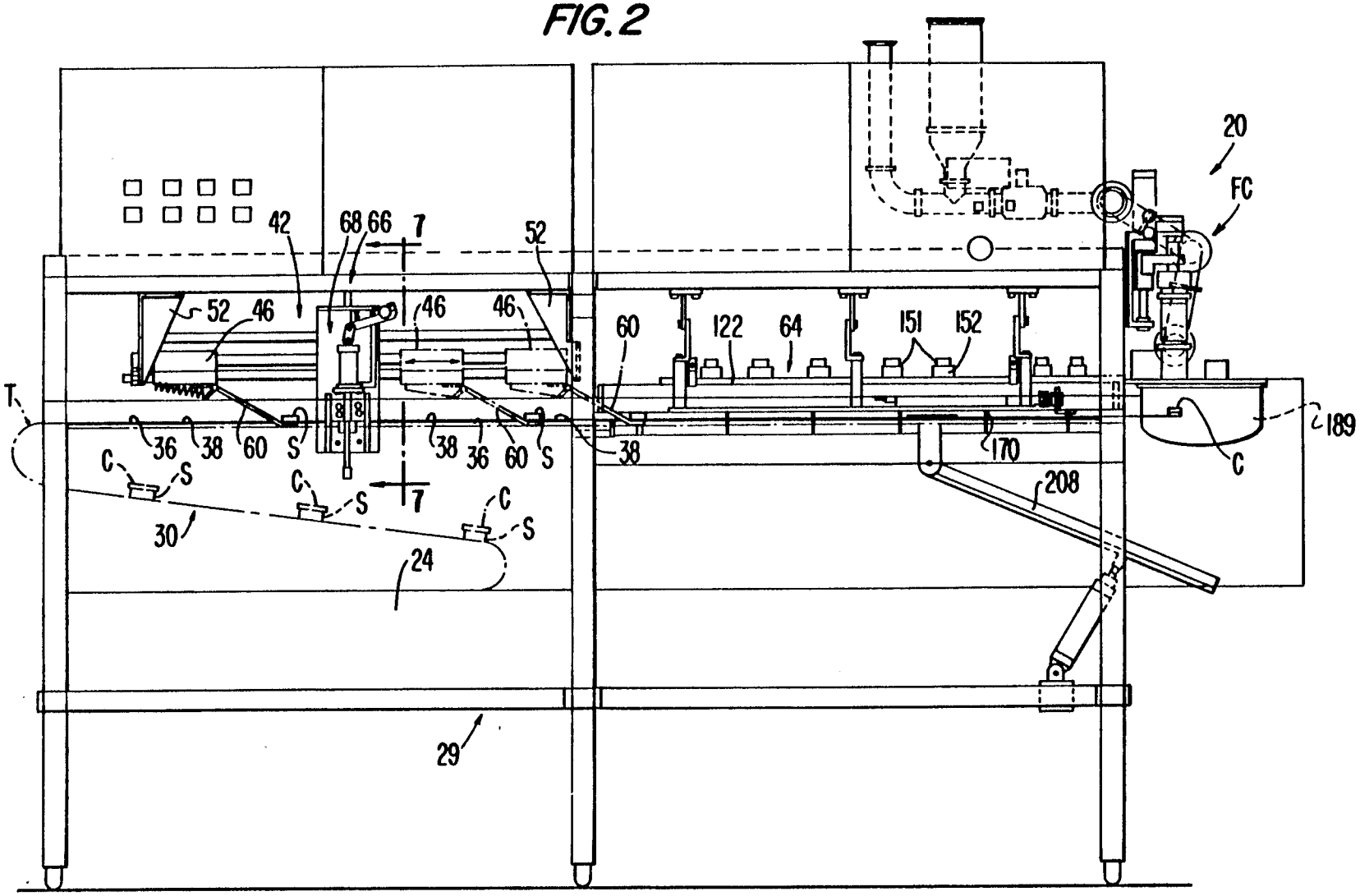
FIG. 2 is a fragmented elevational view with portions of the machine removed for purposes of clarity in illustrating certain components of the machine.
Figure 4:
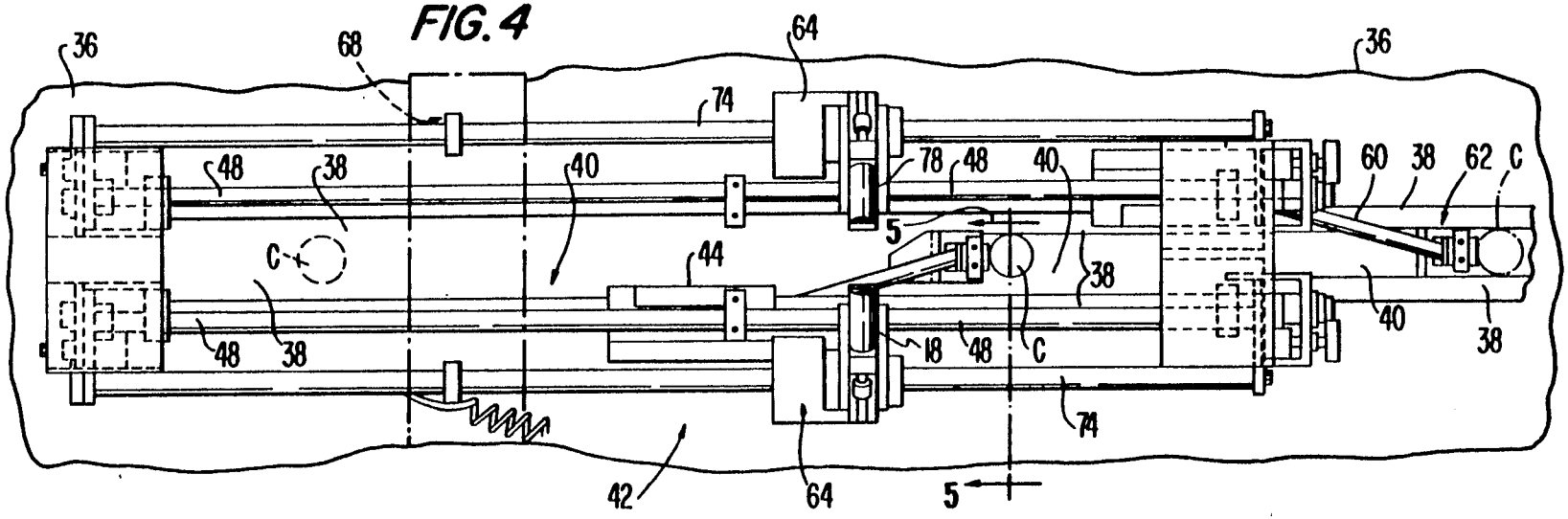
FIG. 4 is a planar view illustrating the bag feeding mechanism of the filling machine.
Figure 3:
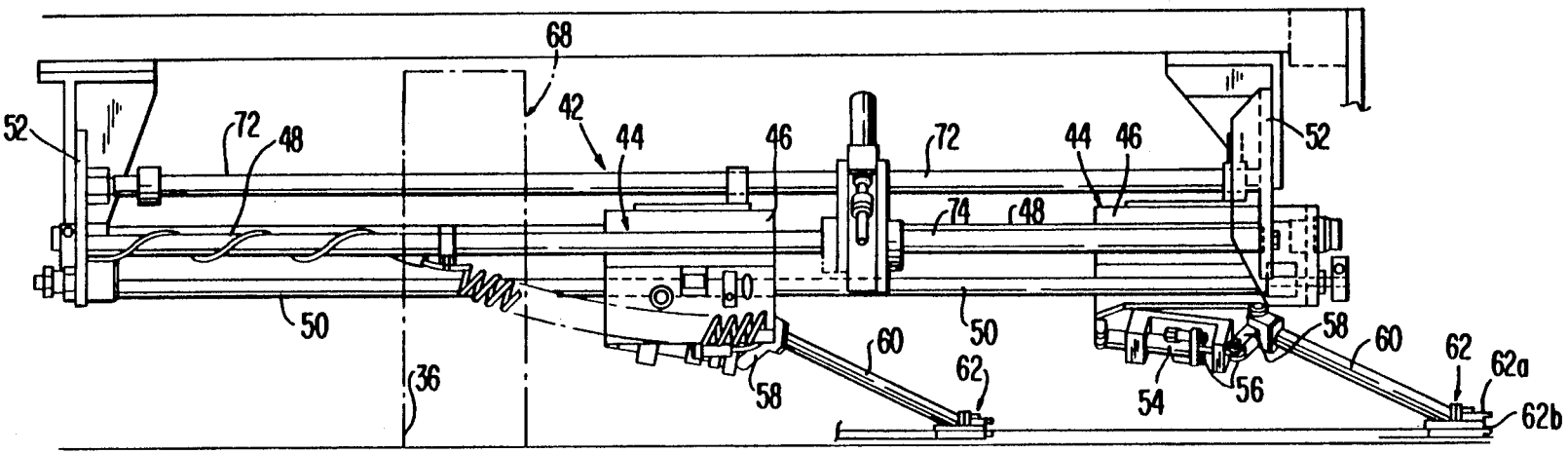
FIG. 3 is a side elevational view of a bag feeding mechanism.
Figure 6:
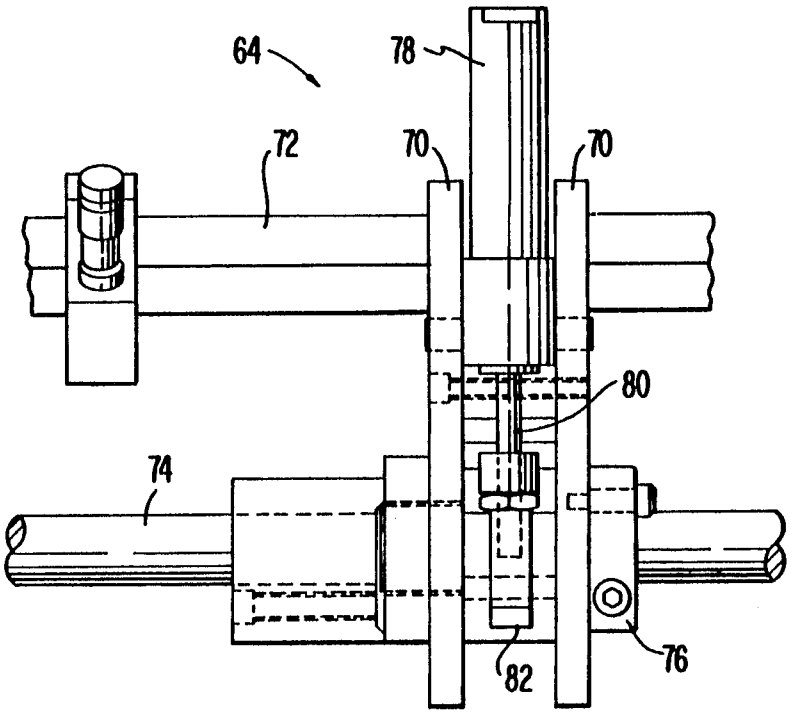
FIG. 6 is a fragmented and enlarged side elevational view.

At the beginning of operation of the filling machine 20, both pushing devices 46 are in their leftwardmost starting position, only one of which is shown in FIG. 2. One pusher arm 60 is elevated the other device 46 is positioned behind the spout S in the channel 40. As the piston-cylinder 48 is actuated, its piston (not shown) advances rightwardly towards the sterilizing assembly 64. In so doing the pushing device 46 moves therewith. This movement continues until the pushing device 46 is physically stopped as will be described so that the separating unit 68 can operate and cut the adjacent bags 22 along the seams P. Each of the pushing devices 46 function in sequence so that after the first spout S is advanced by one of the pushing devices 46, the pusher arm 60 of the tracking pushing device 46 is lowered into the channel 40 behind the spout S so as to push the spout forwardly when the tracking device is advanced.

There is a stopping assembly 64 for each of the spout pushing devices 46. Each of the stopping assemblies 64 includes a stop bracket assembly 70 which is slidably mounted on a square mounting bar 72 and a stop bar 74; both of which longitudinally extend and are connected to and between the depending mounting brackets 52. It will be noted that the position of each of the stopping assemblies 70 along the bars 72 and rods 74, their positions can be changed depending upon the size of the bags to be filled. In this regard, each bracket assembly 70 is positioned so as to stop the spout S and thereby the strip T, whereby the transverse perforation seam P are properly aligned relative to the separating unit 68. Axial adjustment of each bracket assembly 70 is accomplished by adjusting the axial position of the clamp collar 76 attached to the bracket assembly and to the stop rod 74. The stop bracket assembly 70 provides a simplified approach for accommodating different bag sizes.

Basically, the stopping assemblies 70 each includes an air cylinder 78 which is mounted on the bracket assembly 70 in the orientation best shown in FIG. 5. A piston rod 80 is extendible and retractable from the air cylinder 78. A distal end of the piston rod 80 is connected to an end of an elongated stopping bar 82 which is mounted on mounting rod 72 for pivotal movement thereabout between a blocking position and a non-blocking position. In the blocking position illustrated in FIG. 5, the stopping bar 82 is pivoted into physical interference with the pushing device 46. The latter is positioned accurately for separation by the separating unit 68. When the pushing device 46 is halted, the strip seam P should be positioned so that it can be severed by the separating unit 68.

Retraction of the piston rod 80 will cause the stopping bar 82 to pivot out of the path of movement of the pushing device 46. This latter function is achieved following completion of the separating step to be described. Also provided is a proximity switch (not shown) which senses the position of the pushing device 46 so as to allow actuation of the air cylinder 78 to cause the piston rod 80 to extend and have the corresponding stop bar 82 pivot out of the interfering position.

Figure 7:
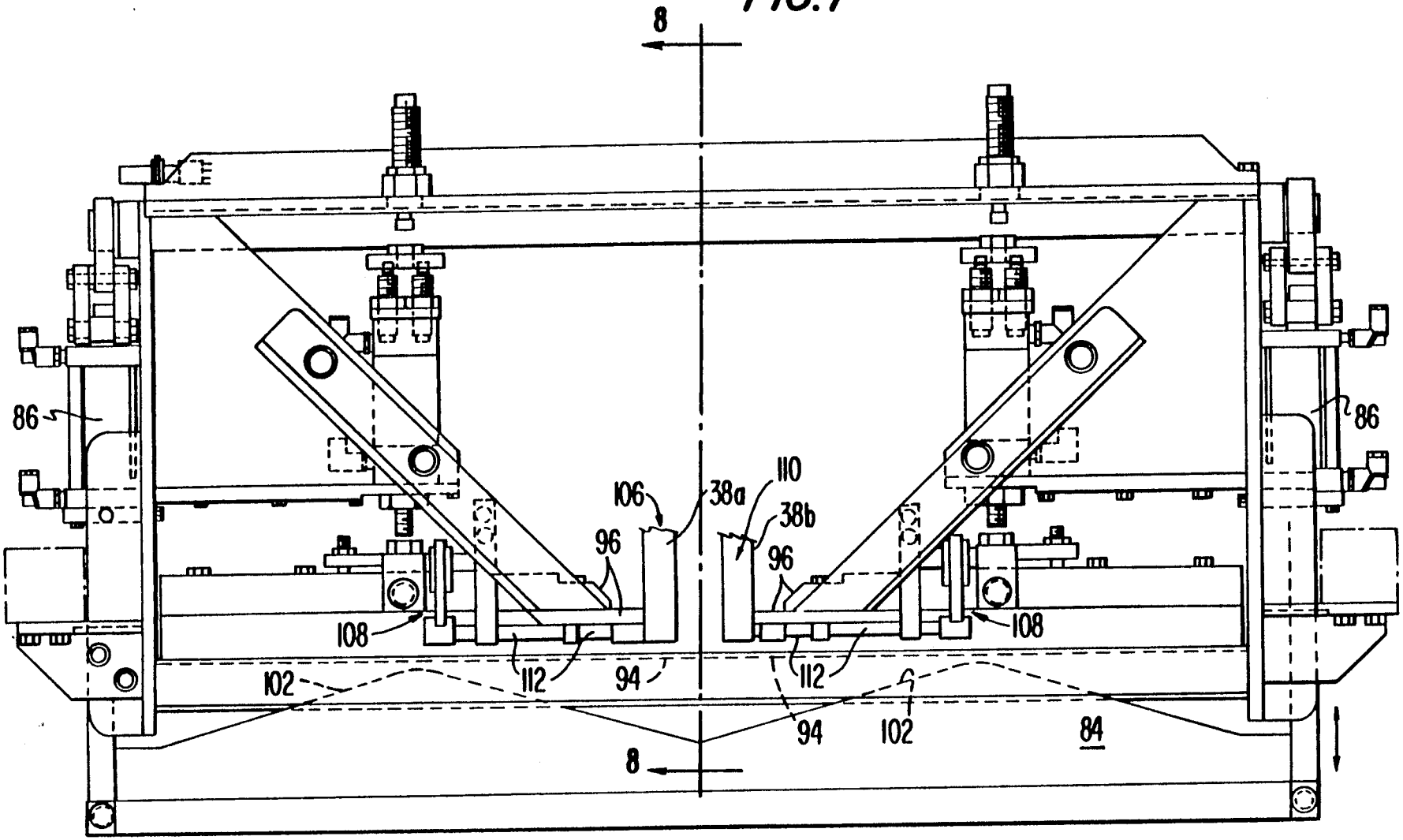
FIG. 7 is a view taken along lines 7—7 appearing in FIG. 1 and illustrating a separating device made according to the present invention.
Figure 8:
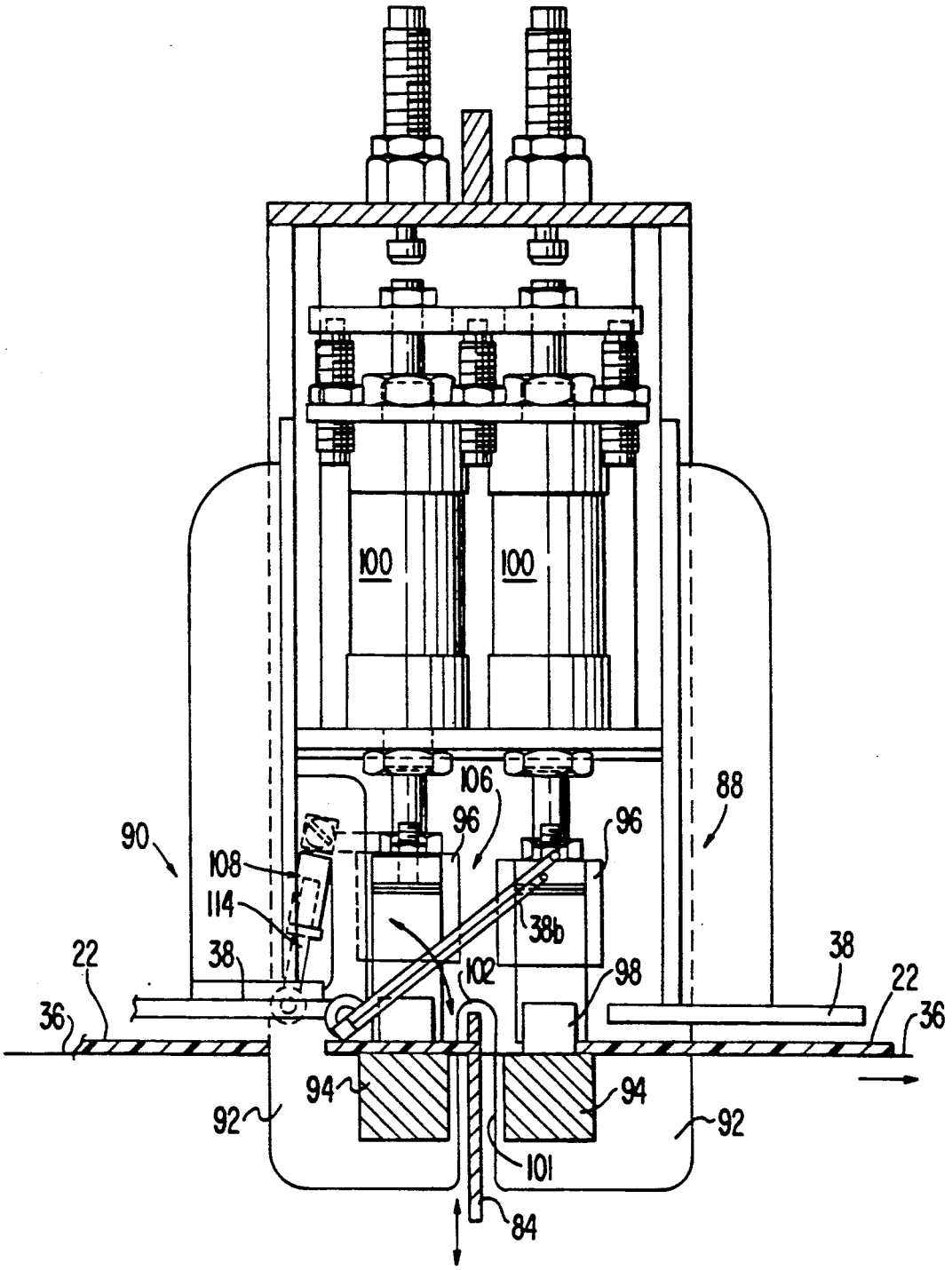
FIG. 8 is a side elevation taken along line 8—8 appearing in FIG. 7 showing a bridge mechanism of the present invention.

Reference is made to FIGS. 7 and 8 for showing the separating unit 68. Only that structure and function of this known unit as well as the modifications thereto which contribute to an understanding of the present invention will be set forth. The separating unit 68 includes a separating blade 84 and a pair of air cylinders 86 connected at opposite ends of the blade to raise and lower the blade. Also, provided is a rearward and forward pair of clamping means or devices, 88 and 90, respectively. Each of the clamping devices 88 and 90 includes a pair of laterally separated and fixed clamping jaws 92 having bag engaging pads 94 formed on the upper side thereof. The bag engaging pads 94 engage across each bag 22 on opposite sides of the blade 84. This occurs in known fashion because each of the movable clamping jaws 96 is vertically movable and includes a bag engaging pad 98. The rearward and forward pair of movable jaws 96 are simultaneously actuated by air cylinder 100 to tightly clamp respective bags on opposite sides of the blade 84. The rearward and forward clamping means 88 and 90 are positioned on opposite sides of an opening 101 formed in the supporting bed 36 and are spaced apart relative to each other so that the separating blade 84 can separate the adjoining bags at the perforation seam P. The separating blade 84 with its cutting edge 102 is raised upwardly by actuation of the pair of air cylinders 86 mounted on opposite ends of the bag separating unit 68. As a result, the blade 84 is moved from a non-separating position (FIG. 7) to a raised separating position (FIG. 8) which cuts the adjacent bags 22 entirely along the perforated seam. The foregoing structure and function are known, but an aspect of this invention employs an improved track bridging assembly 106 which allows the separating blade 84 to cut across the entire perforated seam P instead of in sections.

According to this invention, the improved track bridge assembly 106 includes a pivoting mechanism 108 associated with each movable jaw 96. The pivoting mechanism 108 interconnects the movable jaws 96 on the clamping device 90 to a track bridge mechanism 110 that is fixed to the separating unit in such a manner that upward movement of the movable jaws 96 and the cutting blade 84 serves to raise the track bridge mechanism 110. Accordingly, the cutting blade 84 is able to separate across the entire perforated seam P without interference by the spout track. Since the perforations P are separated along their entire length, there is less of a likelihood of the bags 22 to tear when a separated bag is subsequently advanced. Following the separating movement, the separating blade 84 is moved to its lower non-cutting position under the influence of the noted air cylinders 84. Due to the pivoting mechanism 108, the track bridging mechanism 110 is lowered or pivoted so that its track segments 38*a* and 38*b* can be positioned to be co-linear with the other or downstream portions of the tracks 38. Accordingly, the spouts S of successive bags 22 can be advanced along the path defined by the tracks 38 while at the same time obtaining the advantage of having the separating blade 84 cut entirely through each perforated seam P. Specifically, the pivoting linkage mechanism 108 included a pivot shaft 112 which is attached to bushings affixed to stationary parts of the unit 68 as shown in FIG. 7. One end of the pivot shaft 112 is attached to an appropriate track segment 38*a* while the opposite end is attached to a three axis pivoting lever 114. The pivoting lever 114 has its opposite end attached to the movable clamping jaw 96, as shown and in such a manner that relative vertical movement of the clamping jaws 196 toward and away from each other will effect rotation of the pivot shaft 112, such that the track segments 38*a,b* move between their raised and lowered positions in response to lowering and raising the jaws 96; respectively.

As is the case with the conventional separating subsequent to the separating action, the rearward clamp means 88 will remain stationary, while the pushing device 46 is allowed to advance the separated bag 22 towards the filling and capping mechanism FC as will be described. It will be understood, of course, that the forward clamping means 90 is actuated to release the clamping pressure on the cut bag. This takes place by virtue of the air cylinders 100 moving the movable jaws 96 upwardly. Prior to the bag being advanced by the pushing device 46, the air cylinder 78 is actuated to move the stopping member 82 out of interference with the pushing device 46. In this manner, the piston cylinder 48 is operable to advance the pushing device 46 towards the sterilization chamber. Such forward movement of the pushing device 46 and separated bag 22 will continue until the pushing device 46 encounters a pneumatic brake which momentarily holds the separated bag at a selected position. This occurs while a prior bag is being uncapped, filled and recapped at the filling and capping mechanism FC. The pneumatic brake, in effect, is achieved by air being introduced into the piston-cylinder 48 on opposite sides of the piston to effect the noted braking action. This provides a physical stop which prevents overtravel of the pusher device 46. This position is selected by a proximity switch (not shown) being placed in a suitable position whereby it detects the proximity of the pusher device 46 so that it can signal a fluid controller to introduce the braking arm. The reason for moving the bag following separating is to increase the production rate of the filling machine 20. The closer the separated bag moves to the sterilization chamber or to the filling head while a prior bag is being filled serves to reduce the travel time of the next bag during a subsequent filling cycle. This increases the production rate.

At the completion of a filling and capping cycle for a single bag, the pneumatic brake is released by suitably venting the brake side of the piston-cylinder 48. Thereafter, the pushing device 46 moves under the influence of the piston-cylinder forwardly until it hits a stop screw (not shown) on the rightward mounting bracket 52. In this regard, note the rightmost illustrated pushing device 46.

Figure 9:
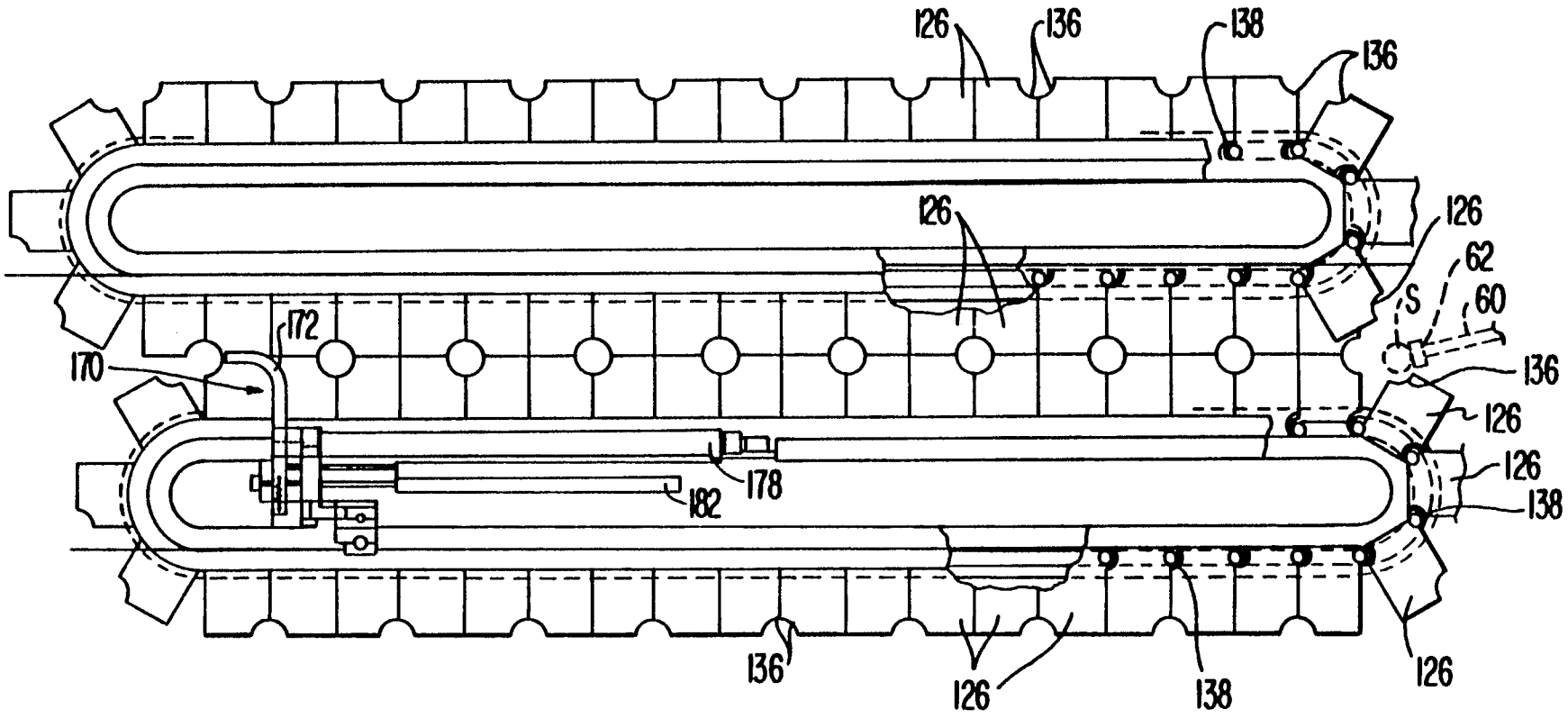
FIG. 9 is a planar view of a portion of a conveying mechanism forming part of the sterilization assembly of the present invention.
Figure 10:
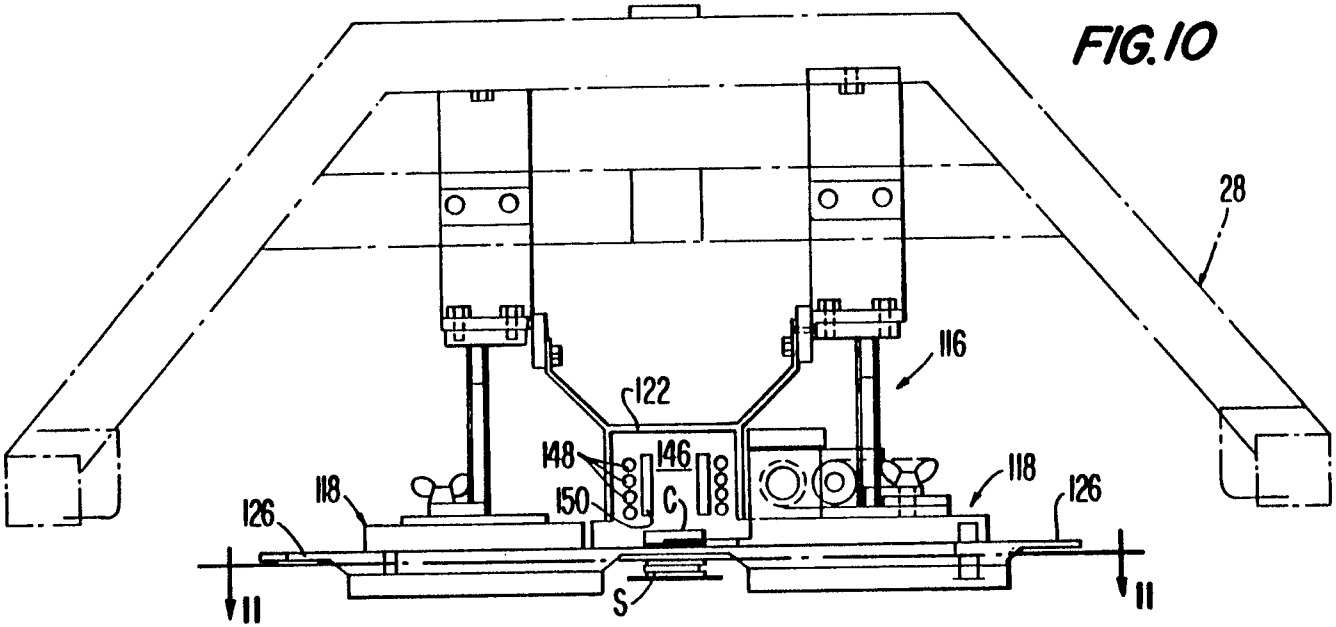
FIG. 10 is an end view of a conveying assembly made according to the present invention.

As seen in FIGS. 2 and 9, the pushing device 46 and its associated pusher arm 60 serve to push a spout S into a sterilization station 116. The sterilization station 116 includes a sterilization conveyor assembly 118 (FIG. 9) and a sterilizing assembly 120. In this embodiment, a sterilizing station is provided, however, it is within the scope of the present invention to provide a filling machine which has the filling and capping head assembly FC positioned at the downstream end of the feeder and separator 30. Essentially, the sterilization conveying assembly 118 is effective to receive respective ones of the spouts S as shown in FIG. 9 and defines an elongated path along which the spouts S may travel during sterilization and ultimate transfer to the filling and capping head assembly FC. The sterilizing assembly 120 (FIGS. 13 and 14) functions to sterilize the caps C and spouts S exposed therein during transfer therethrough by the noted sterilizing conveying assembly 118. It should be emphasized that the feeder and separator assembly 30 is effective to push the spouts S through the sterilizing conveying assembly 118 in a simple but highly efficient manner. It should be noted that the sterilizing conveying assembly 118 could be driven other devices. It will also be appreciated that the strip advancing assembly 42 is in the chamber 26 and is, therefore, heated and ventilated to the same temperature and pressure as the bags 22. The present invention contemplates that other strip and spout advancing assemblies can be used for introducing the spouts and separated bags to the sterilizing station 120.

Figure 11:
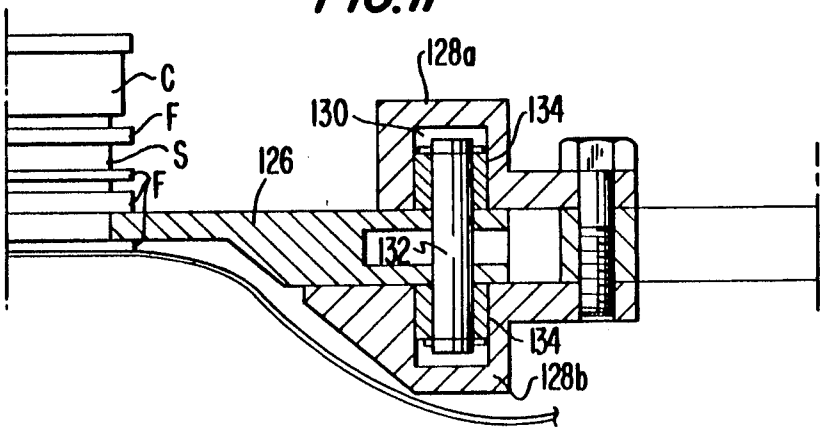
FIG. 11 is an exploded section detail of the conveying mechanism as shown in FIG. 10.

In FIGS. 10, 11, 13 and 14, the sterilizing assembly 12 is seen to include an elongated housing cover or tunnel 122 which is in sealing relationship to the spouts S and caps C as well as the upper portion of the slats which are thereunder. The conveying assembly 118 as shown in FIG. 9 includes a pair of laterally spaced apart and longitudinally extending endless type conveyors 124. The conveyor 124 moves the spouts S as well as functions as a movable sealing partition for the sterilizing assembly 120. Each endless conveyor 124 includes slats where are arranged to travel in an endless oval-shaped loop. As shown in FIG. 11, the endless conveyor 124 includes upper and lower channel defining members 128*a, b* which define a continuous oval-shaped slat channel 130. Each of the slats 126 include a vertical bearing shaft 132 having roller bearings 134 at opposite ends thereof, which ride within the channel 130. As a consequence, the slats 126 are freely movable along the oval-shaped slat channel 130. The slats 126 are normally in abutting relationship to each other and, as noted, define a bottom and moveable chamber wall to the tunnel 122. At the distal end corner of each slat as an arcuate spout engaging shoulder 136 which is arranged to cooperate with other adjacent shoulders 136, as shown in FIG. 9, so as to completely encircle and fit between adjacent flanges F on the spout S. In this manner, the spouts can be conveyed along the length of the tunnel 122. At a diagonally opposite slat corner is an arcuate recess 138 which allows arcuate movement of the slats 126 without interference. The slats 126 are made of a suitable plastic material that withstand the temperature and sterilizing substances. The foregoing arrangement resists undesired leakage of the hydrogen peroxide gaseous medium introduced into the tunnel 122.

Figure 12:
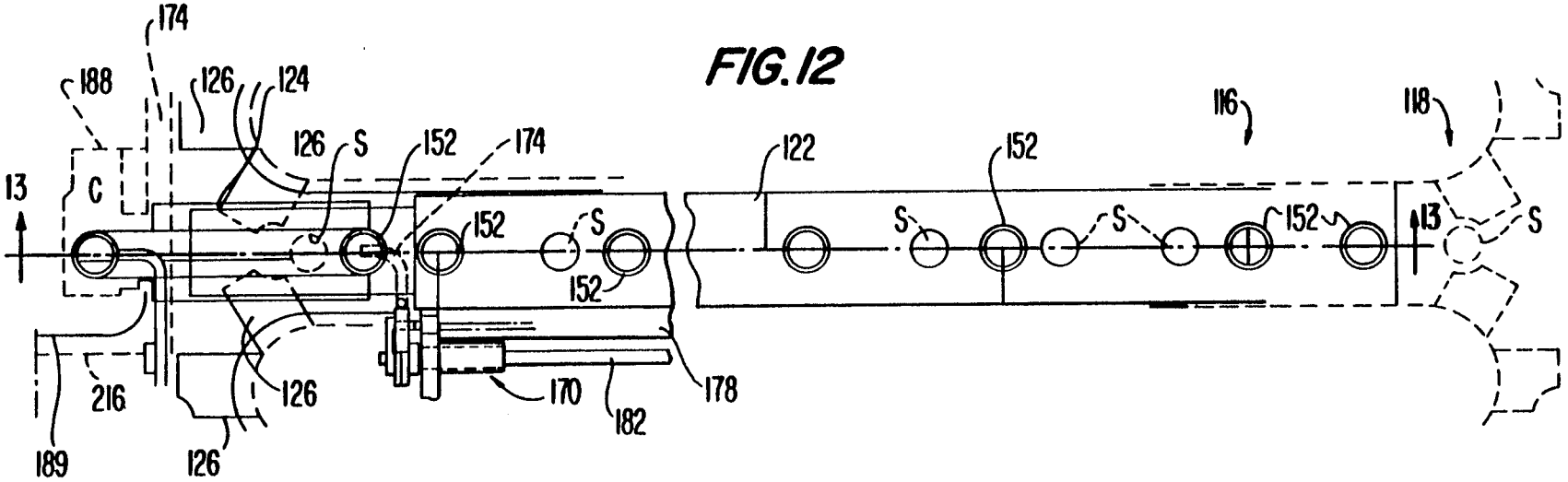
FIG. 12 is a planar view of a sterilization chamber of the present invention with portions removed for clarity.
Figure 13:
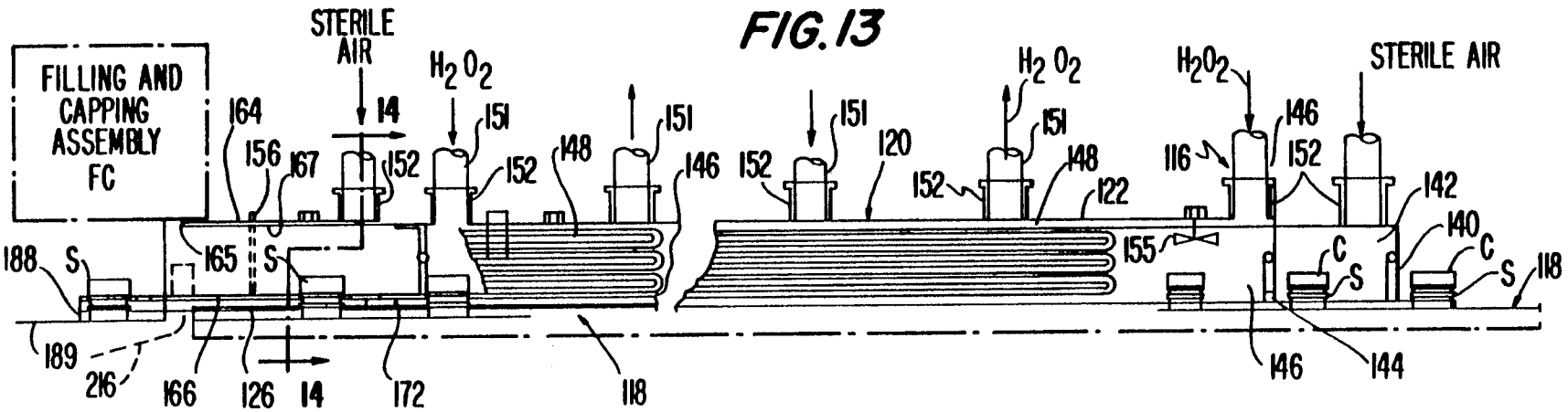
FIG. 13 is a sectional view taken along section line 13—13 appearing in FIG. 12.
Figure 14:
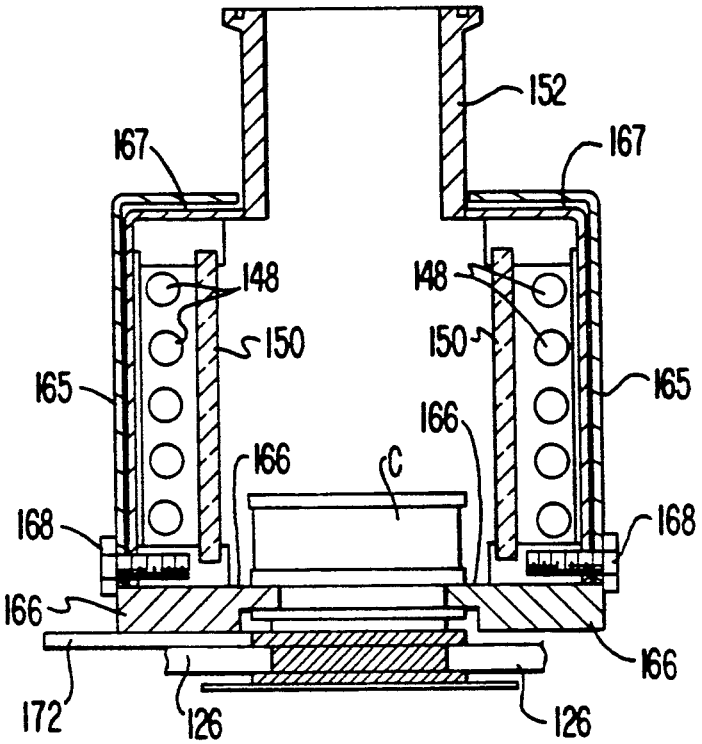
FIG. 14 is a section view taken along section line 14—14 appearing in FIG. 13.
Figure 15:
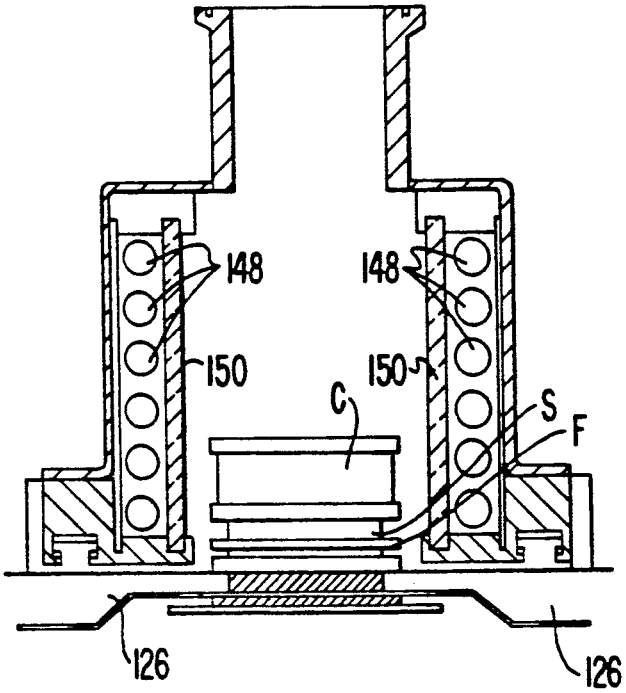
FIG. 15 is a sectional view taken along section line 15—15 appearing in FIG. 13.

Reference is now made to FIGS. 12 and 13 for better describing the tunnel 122. The tunnel 122 is elongated and substantially sealed, and includes an inlet door 140 which swings inwardly and is spring biased (not shown) to a closed position. The door 140 leads into a pressurized chamber 142. Another spring biased door 144 leads into a sterilizing chamber 146. Extending along each side wall of the tunnel 122 is a plurality of ultraviolet lamps generally designated by reference character 148. The ultraviolet lamps 148 are suitably energized with appropriate power and generate ultraviolet energy having a wavelength in a range of approximately 250 to 258 nanometers (nm); with 254 nm being preferred. Glass panels 150 protect the ultraviolet lamp 148. A suitable source (not shown) of heated gaseous hydrogen peroxide is introduced and removed by tubing 151 into a plurality of spaced tunnel spouts 152 along the length of the tunnel 122. This provides adequate distribution of the gaseous hydrogen peroxide. Also, the endmost tunnel spouts 152 allow introduction of pressurized and sterile air. The combination of the ultraviolet energy coupled with the gaseous hydrogen peroxide medium in the chamber 146 serves to enhance sterilizing by reducing significantly the kill time. Accordingly, the time period a spout needs to be maintained in a sterilizing atmosphere to satisfy certain government standards, for example, is reduced significantly. The benefit of this time reduction is, of course, that the number of bags which can be filled during a given period of time is accordingly increased. The sterilizing conveying assembly 118 is operated at a speed so as to move the successive ones of the spouts S therethrough in a time period which coincides with at least that period of time needed to adequately sterilize the spouts S and caps C using the above procedure. The gaseous hydrogen peroxide source is a commercial unit. The gaseous hydrogen peroxide source is described generally in U.S. Pat. No. 4,863,688. Since this apparatus does not, per se, form an aspect of the invention, the last-noted patent is incorporated herein by reference for purposes of describing such an apparatus. The hydrogen peroxide, in the vapor state, can have its concentration vary from about 29% to 35%. By increasing the concentration, the ability to kill microorganisms within a given contact period will increase accordingly. It will be further understood that the higher the concentration, the higher the ability to kill spore and non-spore types of microorganisms. The caps and spouts are heated in the sterilizing assembly by the heaters in the chamber 26a. Such heated temperatures minimize the temperature differentials between the spout and cap and the hydrogen peroxide gas, so as to minimize or eliminate condensation on such surfaces. A more detailed description of the combination of hydrogen peroxide gas and ultraviolet radiation is described in copending U.S. patent application Ser. No. 07/575,361, entitled, "Process and Apparatus For Sterilizing Surfaces". A plurality of fans 155 (one of which is shown) are mounted through suitable fittings for operation in the chamber 146 to insure better distribution of the hydrogen peroxide. The hydrogen peroxide is maintained at a positive pressure.

Following movement of a spout through the sterilizing chamber 146, the same is transferred to and through a tunnel transfer assembly 156. The tunnel assembly 156 is sealed from but adjacent the sterilizing chamber 146 by, in part, a pivotal sealing door 158. The tunnel transfer assembly 156 can have ultraviolet lamps 148 (not shown) as the chamber 146, but that need not be the case. One function of the tunnel assembly 156 is to maintain the sterilized condition of the spouts S and caps C as they travel from the sterilizing chamber 146 to and into the filling head and capping assembly FC. Towards this end, sterilized air enters the leftmost (as viewed in the drawings) inlet spout 152 leading into a transfer chamber 164 which is defined by the assembly 156. This maintains the sterile condition of the sterilizing chamber 146. The transfer tunnel assembly 156 can also be, if desired, initially sterilized with a charge of gaseous hydrogen peroxide and ultraviolet energy as is done in the sterilization chamber 146. The tunnel transfer assembly 156 is monitored by a suitable pressure sensor (not shown) so as to make sure that an adequate pressure exists in the chamber 164. Should the pressure fall below the preselected value, a control mechanism of the filling machine 20 is set to cease operation of the filling machine 20.

Continued reference is made to the transfer tunnel assembly 156. In this embodiment it includes a pair of elongated tunnel track carrying portions 165, each of which includes a movable track 166 connected to a bottom wall thereof. The movable tracks are axially aligned with the conveying path defined by the slats 126. The tunnel track carrying portions 165 are slidably mounted on tunnel segment 167 which is connected to the tunnel 122. The track carrying portions 165 ar secured as by threaded members 168 which ride within elongated slots (not shown) in the track carrying portions 165. In this embodiment, the movable tracks 166 are slightly raised with respect to the plane of the slats 126 for reasons which will be described. The tunnel track portions 165 are mounted with respect to the tunnel segment 167 between extended and retracted positions. When in the illustrated extend position, as shown in FIG. 13, its distal end is in sealing contact with an inner housing 189 of the filler head and capper assembly FC. The inner housing 189 has an opening (not shown) which allows the sterile air from the leftmost inlet spout 152 to enter its filling chamber D. Although not shown, the filling and capping assembly FC is provided with a sterile air line which also introduces sterile air into the chamber D. In this manner, the spouts S and caps C are continuously maintained in a sterile environment following exiting thereof from the sterilization chamber 146. It will be appreciated that when the tunnel housing segment 167 is in the retracted position, the tracks 166 slide over the slats 126 as seen in FIG. 13. The tracks 166 are higher than the slats 126 so that they will engage portions of the spout S which are completely sterilized. This increases the likelihood of only completely sterilized spout portions in the filling chamber D.

Figure 18:
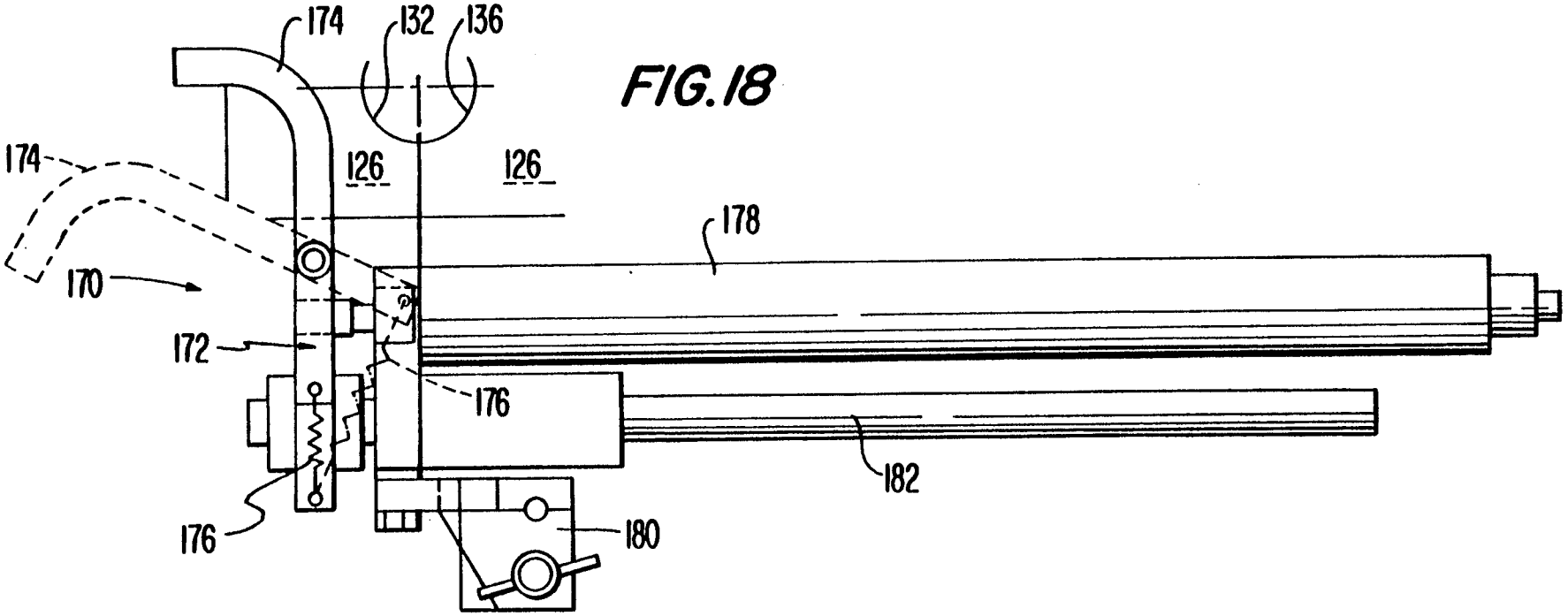
FIG. 18 is an enlarged planar view of components forming part of an end feeder assembly the present invention.

Continued reference is made to FIGS. 13 and 18 for purposes of illustrating the transfer of the spouts S and caps C which are no longer advanced by the conveying slats 126. To facilitate this final transfer of the spouts S and caps C to the filling head and capping assembly FC, there is provided a pusher mechanism 170. This final pushing occurs, of course, following the filling, capping and discharge of a previous bag at the filling and capping assembly FC. Reference is also made to FIG. 18 for depicting the pusher mechanism 170 which includes a pusher arm 172 having pivotally attached to one end thereof a pivotal spout finger 174 which is spring biased by spring 176 to return to the solid line position. The spout finger 174 slides under the tunnel segment 167. An air cylinder 178 is mounted to the frame assembly 28 and has its associated piston rod attached to a pusher arm 172. A bracket 180 supports a guide rod 182 which is provided for stability of the pusher arm 172 so as to prevent rotation of the latter. The pusher arm 172 is moved in response to actuation of the air cylinder 178 so as to advance the spout S exiting the endless conveyors 124 to the filling head and capping assembly FC. Return of the pusher arm 172 to its solid line position (FIG. 18) is achieved by the air cylinder 178. Since the spout finger 174 is pivotal, it will swing out of interference (see phantom line position thereof) with a spout behind that just pushed by the arm 172. The return spring 176 serves to return the arm 172 to its solid line position so that it can advance another spout for another filling cycle.

Reference is now made to FIGS. 1, 2, 12 and 16 for describing the filling head and capping assembly FC which includes a fixed single head filler valve assembly 186 and an uncapping and recapping mechanism 188. Both the single head filler valve 186 and the uncapping and capping mechanism 188 are conventional and a detailed description of their construction and operation will be dispensed with. Only those portions thereof necessary for purposes of understanding the present invention will be described. The uncapping and capping mechanism 188 includes a capping arm 188a which is pivotally and vertically movable within the inner housing 189. The uncapping and capping mechanism 188 functions to lift the cap C from the spout S and pivot the former out of interference with the single filling head valve assembly 186. Thus, the single head filler valve 186 can be lowered into positions in an engagement with the spout S for filling, with fluid, the empty bag 22. A predetermined controlled amount of liquid is metered into the bag 22, by means of a volume flow meter (not shown). The filling liquid may be supplied to the head filler valve 186 from a pressurized system. Following filling, the filler head valve assembly 186 raises and allows the uncapping and capping mechanism 188 to recap the spouts in a known fashion.

Figure 17:
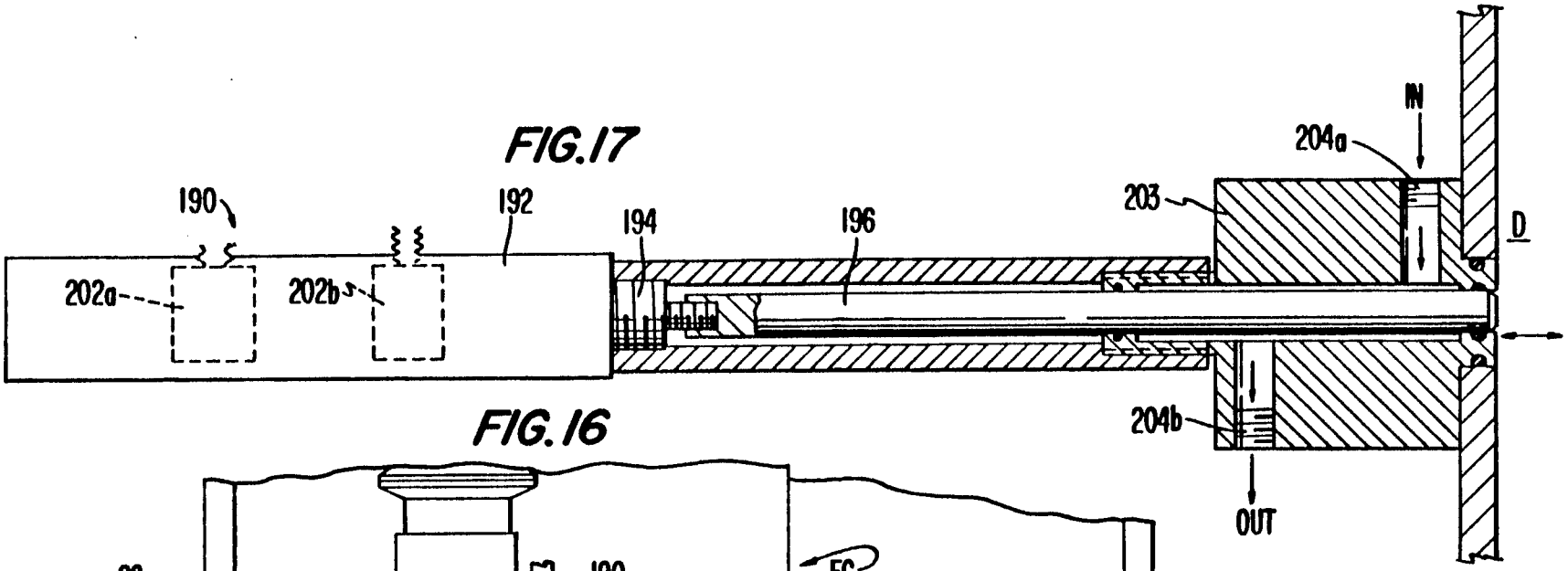
FIG. 17 is an enlarged and partial sectional view of a cap detecting arrangement made according to the present invention.
Figure 16:
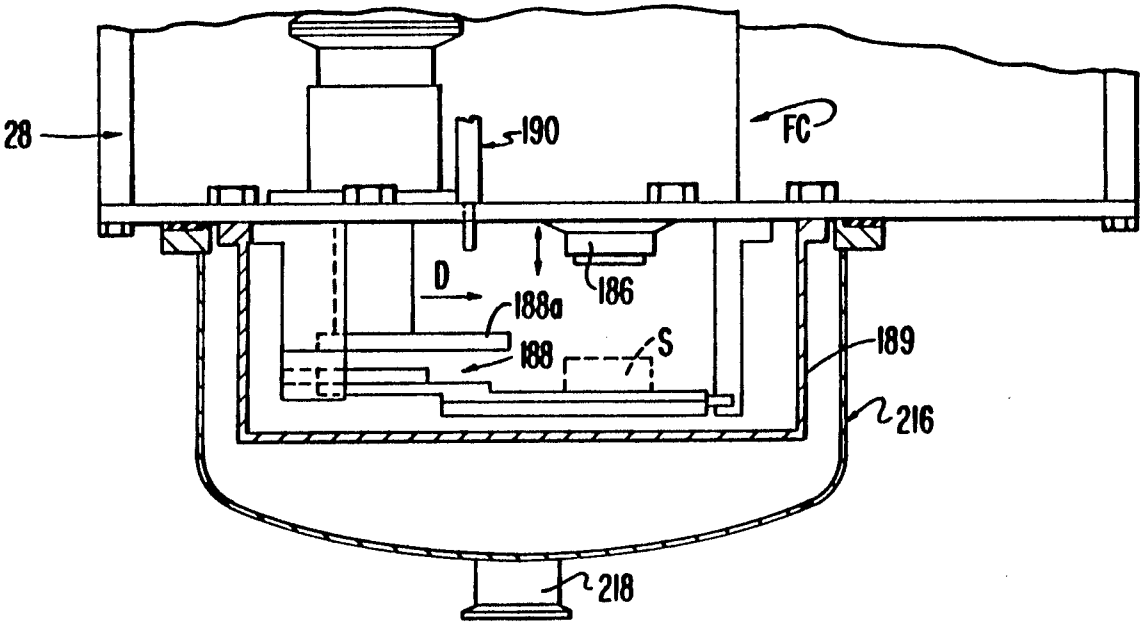
FIG. 16 is a fragmented view partly in section showing details of structure for use with a filling head assembly.

This invention provides for an improved safety feature which includes a cap detect assembly 190. If the pressure of a cap is not detected, then there will be no filling. FIG. 17 shows the cap detector assembly 190 as including an elongated air cylinder arrangement 192. The air cylinder 192 is selectively operable to raise and lower a piston rod 194 so that a distal end portion thereof 196 is lowered into the filling chamber D. The cap detector assembly 190 is attached to the filling head table 200 at a location in alignment with the cap C being in its pivoted uncapping position which is out of alignment with the spout S. The cap C detecting assembly 190 is operable to lower the distal end 196 into the filling chamber D. A pair of vertically spaced apart limit switches, generally indicated by reference numerals 202*a,b* are housed within the cylinder housing 192 and serve to detect the movement of the piston rod 194. The switches 202*a,b* are electrically connected to an appropriate control mechanism (not shown). Lower switch 202*b* is actuated when the piston rod 194 extends to a depth which is indicative of the absence of a cap C in the capping arm of the uncapping and capping mechanism 188. To maintain sterile action, the distal end 196, there is provided a steam housing assembly 203 which has a steam inlet 204*a* and steam outlet 204*b*. It will be appreciated that a suitable stream of steam or other sterilant can flow through these inlets and outlets so as to surround the distal end portion 196. A suitable valving mechanism (not shown) controls the flow of steam through the cap detector assembly.

As indicated, once a bag 22 is completely filled, the head filler is thereafter vertically raised so that the mechanism 188 can recap the spout S within the filling chamber D. As noted, the filling chamber D is maintained sterile by virtue of the sterile air entering inlet spout 162. Additionally, the filling head is also provided with a separate source of sterile air for maintaining the desired sterile condition.

Once each bag 22 has been filled to the desired volume and the spout has been recapped, a pneumatic cylinder arrangement 206 is actuated so as to lower the pivoting discharge table 208 provided with rollers. As a result, the filled bag 22 exits the chamber 26 and drops onto a conveyor (not shown) or the like which serves to convey the sterilized and filled bags 22 to any desired point. The present invention contemplates utilization of a full variety of discharging techniques in this particular industry.

Also shown in FIG. 1, there is provided a remote control device 212 which is placed on a movable pedestal 214, thereby enhancing the versatility of the present filling machine by providing for convenient access to the control panel. The control system (not shown) for controlling the logic functions and timing of the pneumatic and electrical functions of the foregoing system are not shown, and could be constructed in any suitable fashion to achieve the foregoing.

The present invention also contemplates a clean-in-place operation which does not require manual removal of the inner housing or components of the capping and uncapping assembly. In the arrangement envisioned by this invention, a kettle 216 is attached to the bottom side of the filling head plate so as to completely cover the inner housing 189. The kettle 216 by substantially covering the inner housing effectively provides a reservoir for the cleaning solution on both the inside and outside of the inner housing. In this cleaning operation, the fill valve of the single head filler introduces, as is known, a cleaning solution(s) followed by, if desired, an acid solution and a rinsing solution. Each charge of fluid is introduced into the inner chamber D and kettle so as to flood the same. The fluid, as is known, then goes out the sterile air in-line (not shown). It will be appreciated that the cleaning solution and rinsing solution are pumped into the inner chamber D as the product was, and the fill valve is opened and closed, as is known, so as to create turbulence. Alternatively, the fill valve can stay locked open. As noted, the inner chamber sterilant air line becomes the becomes the exit return line for each charge of fluid. A sterilant, such as steam, enters into the filling chamber D so as to sterilize the contents thereof including the spout clamp and cap pivoting arm. This flushing action is known. However, what is new by the present invention is the kettle 216 which encompasses the inner housing. The kettle has a drain spout 218 at the bottom end thereof. This opening is small, such as a fraction of an inch in diameter and does not inhibit the kettle serving as a reservoir as noted. The steam is introduced into by the fill valve through the filler assembly and into the filling chamber D. Accordingly, the parts of the filler head assembly and capper can be cleaned-in-place as well as sterilized without their removal. This represents a significant improvement in cleaning.

The foregoing filling apparatus presents a high speed machine with significantly improved production speeds with lower labor and maintenance costs, as well as enhanced versatility. As a result of the construction of the foregoing apparatus and the enhanced sterilization provided thereby, a long life can be expected with minimum of maintenance required.

According to the present invention, it will be recognized that certain changes may be made in the above described method and apparatus for automatically filling under sterile conditions and sterilizing containers without departing from the scope of the present invention herein involved. It is maintained that all matter contained in this description shall be interpreted as illustrative and not in a limiting sense.

What is claimed is:

1. An apparatus for filling empty spouted and flexible fluid bags with a fluid substance, said filling apparatus comprising:

first means for advancing at least individual ones of the empty bags toward a filling station;

means for sterilizing at least a portion of each spout in a sterilizing chamber;

second means for advancing each spouted bag through said sterilizing means;

said sterilizing means including means for introducing gaseous hydrogen peroxide into said sterilizing chamber and means for irradiating the spouts in said chamber with preselected ultraviolet radiation; and, means for filling the empty bags with a fluid substance in a sterile environment;

said first advancing means includes separating means for separating individual bags from a strip of flexible strips;

said first advancing means includes a pair of intermittently reciprocatable pushing assemblies, each mounted in laterally spaced apart relationship to each other; each of said pushing assemblies includes a pivotal spout engaging arm having one position engaged with a spout and a second position removed from the spout; each of said pushing assemblies includes means operable for selectively moving said spout engaging arms between said engaged and removed positions; each of said arms being oriented at an angle such that they do not interfere with the other said arm along the predetermined feed path when in said removed position.

2. The apparatus of claim 1 further including capping means operatively associated with said filling means and being operable for uncapping a capped spout and recapping the spout following the filling of the bag.

3. The apparatus of claim 2 wherein said sterilization means includes tunnel means for sealingly receiving the cap and spout; and said second advancing means including conveying means comprising a pair of laterally spaced apart endless conveyor assemblies in combination with said tunnel means to define said sterilization chamber, each of said conveyor assemblies including a plurality of slats horizontally extending therefrom, each of said slats having at least a recess formed thereon so as to form, in combination with recesses of adjacent ones of said slats, a spout engaging arrangement for engaging and allowing advancement of each spout.

4. The apparatus of claim 3 wherein said slats are movable in response to said pushing assemblies pushing successive spouts into said conveying means.

5. The apparatus of claim 4 wherein said sterilizing means includes means for transferring successive ones of the spouts and caps from said sterilizing chamber to said filling and capping means in a sterile environment.

6. The apparatus of claim 5 wherein said transferring means includes a slidably mounted transfer housing which is slidable between said sterilizing chamber and said filling and capping means.

7. The apparatus of claim 6 wherein said transferring means includes means for introducing sterile air at positive pressure in said transferring means to define the sterile environment.

8. The apparatus of claim 7 wherein said transferring means includes end pushing means operable for pushing successive spouts from said conveying means to said filling and capping means, and said slidable housing includes track means for receiving and guiding successive spouts from said sterilizing chamber to said filling and capping means in response to operation of said end pushing means.

9. The apparatus of claim 8 wherein said tracks engage the spout at a position elevated with respect to where said slats engage the spout.

10. The apparatus of claim 2 wherein said filling and capping means includes a housing which houses components of said filling and capping means; and kettle means releasably connectable to said filling and capping means so as to substantially surround said housing of said filling and capping means so as to form a reservoir for cleaning fluid introduced thereinto and removed therefrom which permits clean-in-place cleaning of components in said filling and capping means.

11. The apparatus of claim 1 wherein said means for irradiating and said means for introducing gaseous hydrogen peroxide are operable simultaneously.

12. The apparatus of claim 11, wherein said ultraviolet radiation has a wavelength in the range of from about 200 nm to 280 nm.

13. The apparatus of claim 12, wherein said irradiating means provides ultraviolet wavelengths at 254 nm.

14. The apparatus of claim 1 further including means for heating the spouts in said sterilizing means.

15. An apparatus for filling empty spouted and flexible fluid bags with a fluid substance, said filling apparatus comprising:

means first including pushing assemblies for advancing at least individual ones of the empty bags towards a filling station;

means for sterilizing at least a portion of each spout in a sterilizing chamber;

second means for advancing each spouted bag through said sterilizing means;

said sterilizing means including means for introducing gaseous hydrogen peroxide into said sterilizing chamber and means for irradiating the spouts in said chamber with preselected ultraviolet radiation; and, means for filling the empty bags with a fluid substance in a sterile environment;

said first advancing means includes separating means for separating individual bags from a strip of flexible strips;

said first advancing means includes track means for guiding spouts of successive bags in response to movement of said pushing assemblies.

16. The apparatus of claim 15 wherein a portion of said track means includes bridging means which cooperates with said separating means so that said bridging means is raised when said separating means separates adjacent bags along an entire transverse perforated seam between the adjacent bags and is lowered to a position which allows spouts to travel therealong to said sterilizing means when said separating means is in a non-serving mode.

17. The apparatus of claim 16 wherein said bridging means includes pivoting means for allowing pivoting of said bridging means.

18. An apparatus for filling empty spouted and flexible fluid bags with a fluid substance, said filling apparatus comprising:

first means for advancing at least individual ones of the empty bags toward a filling station;

means for sterilizing at least a portion of each spout in a sterilization chamber;

second means for advancing each spouted bag through said sterilizing means;

said sterilizing means including means for introducing gaseous hydrogen peroxide into said sterilizing chamber and means for irradiating the spouts in said chamber with preselected ultraviolet radiation; and, means for filling the empty bags with a fluid substance in a sterile environment;

said first advancing means includes separating means for separating individual bags from a strip of flexible strips;

means for preheating the bags and spouts entering said separating means.

19. A method of filling empty spouted flexible fluid bags with a fluid substance, said method comprising the steps of:

advancing at least individual ones of the empty bags;

sterilizing at least a portion of each spout in a sterilizing chamber;

advancing each spouted bag through the sterilizing chamber;

said sterilizing step including introducing gaseous hydrogen peroxide into the sterilizing chamber and irradiating the spouts with preselected ultraviolet radiation; and filling the empty bags with a fluid substance in a sterile environment;

said advancing steps include providing a pair of intermittently reciprocatable pushing assemblies, each mounted in laterally spaced apart relationship to each other; each of said pushing assemblies includes a pivotal spout engaging arm having one position engaged with a spout and a second position removed from the spout; each of said pushing assemblies includes means operable for selectively moving said spout engaging arms between said engaged and removed positions; each of said arms being oriented at an angle such that they do not interfere with the other said arm along the predetermined feed path when in said removed position and pushing a spout to advance an associated bag when an arm of one pushing assembly is in a spout engaging position while retracting an arm of the other pushing assembly when it is in its removed position.

20. The method of claim 19 wherein said step for irradiating and said step for introducing gaseous hydrogen peroxide are operable simultaneously.

21. The method of claim 19 wherein said advancing step includes separating individual bags from a strip of flexible strips.

22. The method of claim 19 further including the step of providing a capping means operatively associated with the filling step and operable for uncapping a capped spout and recapping the spout following the filling of the bag.

23. The method of claim 19, wherein the ultraviolet radiation has a wavelength in the range of from about 200 nm to 280 nm.

24. The method of claim 23, wherein said irradiating step provides ultraviolet wavelengths at 254 nm.

25. The method of claim 23 further including a step of heating the spouts and caps in the sterilizing chamber.

26. A method of filling empty spouted flexible fluid bags with a fluid substance, said method comprising the steps of:

advancing at least individual ones of the empty bags;

sterilizing at least a portion of each spout in a sterilizing chamber;

advancing each spouted bag through the sterilizing chamber;

said sterilizing step including introducing gaseous hydrogen peroxide into the sterilizing chamber and irradiating the spouts with preselected ultraviolet radiation; and filling the empty bags with a fluid substance in a sterile environment;

further including the step of providing the sterilization chamber with tunnel means for sealingly receiving the cap and spout; and conveying the cap and spout by conveying means comprising a pair of laterally spaced apart endless conveyor assemblies in combination with the tunnel means to define the sterilization chamber, each of the conveyor assemblies including a plurality of slats horizontally extending therefrom, each of the slats having at least a recess formed thereon so as to form, in combination with recesses of adjacent ones of the slats, a spout engaging arrangement for engaging and advancing each spout.

27. The method of claim 26 further comprising the step of moving the slats in response to the pushing assemblies pushing successive spouts into the conveying means.

28. The method of claim 27 further comprising the step of transferring successive ones of the spouts and caps from the sterilizing chamber to the filling and capping assembly in a sterile environment defined by a transfer tunnel.

29. The method of claim 28 further comprising the step of introducing sterile air at positive pressure in the transfer tunnel.

30. The method of claim 29 wherein said transferring step includes pushing successive spouts from the conveying means to a filling and capping means.

31. The method of claim 28 further including a step of preheating the bags and spouts.

32. An apparatus for filling empty spouted and flexible fluid bags with a fluid substance, said filling apparatus comprising:

first means for advancing at least individual ones of the empty bags toward a filling station;

second means for advancing each spouted bag through a sterilizing means;

means for filling the empty bags with a fluid substance in a sterile environment; and, said first advancing means includes a pair of intermittently reciprocatable pushing assemblies, each mounted in laterally spaced apart relationship to each other; each of said pushing assemblies includes a pivotal spout engaging arm having one position engaged with a spout and a second position removed from the spout; each of said pushing assemblies includes means operable for selectively moving said spout engaging arms between said engaged and removed positions; each of said arms being oriented at an angle such that they do not interfere with the other said arm along a predetermined feed path when in said removed position.

33. An apparatus for filling empty spouted flexible fluid bags with a fluid substance, said filling apparatus comprising:

first means for advancing at least individual ones of the empty bags;

means for sterilizing at least a portion of each spout;

second means for advancing each spouted bag through said sterilizing means;

said sterilizing means including means for introducing gaseous hydrogen peroxide into said sterilizing means;

means for filling the empty bags with a fluid substance in a sterile environment;

said first advancing means includes separating means for separating individual bags from a strip of flexible spouted bags;

said first advancing means includes a pair of intermittently reciprocatable pushing assemblies, each mounted in laterally spaced apart relationship to each other; each of said pushing assemblies includes a pivotal spout engaging arm having one position engaged with a spout and a second position removed from the spout; each of said pushing assemblies includes means operable for selectively moving said spout engaging arms between said engaged and removed positions; each of said arms being oriented at an angle such that they do not interfere with the other said arm along a predetermined feed path when in said removed position;

a portion of said track means includes bridging means which cooperates with said separating means so that said bridging means is raised when said separating means separates adjacent bags along an entire transverse perforated seam between the adjacent bags and is lowered to a position which allows spouts to travel therealong to said sterilizing means when said separating means is in a non-severing mode, wherein said bridging means includes pivoting means for allowing pivoting of said bridging means.

34. An apparatus for filling empty spouted and flexible fluid bags with a fluid substance, said filling apparatus comprising:

first means for advancing at least individual ones of the empty bags toward a filling station;

means for sterilizing at least a portion of each spout in a sterilizing chamber;

second means for advancing each spouted bag through said sterilizing means;

said sterilizing means including means for introducing gaseous hydrogen peroxide into said sterilizing chamber and means for irradiating the spouts in said chamber with preselected ultraviolet radiation;

means for filling the empty bags with a fluid substance in a sterile environment;

capping means operatively associated with said filling means and being operable for uncapping a capped spout and recapping the spout following the filling of the bag;

said filling and capping means includes housing means which houses components of said filling and capping means; and kettle means releasably connectable to said filling and capping means so as to substantially surround said housing of said filling and capping means so as to form a reservoir for cleaning fluid introduced thereinto and removed therefrom which permits clean-in-place cleaning of components in said filling and capping means.

* * * * *